US010786089B2

(12) United States Patent
Lau et al.

(10) Patent No.: US 10,786,089 B2
(45) Date of Patent: Sep. 29, 2020

(54) BUILT-IN AIR PUMP ASSEMBLY

(71) Applicant: Sun Pleasure Company Limited, San Po Kong, Kowloon (HK)

(72) Inventors: Vincent W. S. Lau, Kowloon (HK); Shouguo Long, Kowloon (HK)

(73) Assignee: Sun Pleasure Company Limited (HK)

( * ) Notice: Subject to any disclaimer, the term of this patent is extended or adjusted under 35 U.S.C. 154(b) by 165 days.

(21) Appl. No.: 16/057,355

(22) Filed: Aug. 7, 2018

(65) Prior Publication Data

US 2020/0046135 A1 Feb. 13, 2020

(51) Int. Cl.

| | |
|---|---|
| ***A47C 27/08*** | (2006.01) |
| ***F04D 25/06*** | (2006.01) |
| ***F04D 25/16*** | (2006.01) |
| ***F04D 29/44*** | (2006.01) |
| ***F04D 29/60*** | (2006.01) |
| ***F04D 25/10*** | (2006.01) |

(52) U.S. Cl.

CPC ..... *A47C 27/082* (2013.01); *F04D 25/0606* (2013.01); *F04D 25/068* (2013.01); *F04D 25/10* (2013.01); *F04D 25/16* (2013.01); *F04D 29/441* (2013.01); *F04D 29/601* (2013.01); *F04D 25/0693* (2013.01)

(58) Field of Classification Search

CPC ... A47C 27/082; F04D 29/441; F04D 29/601; F04D 25/06; F04D 25/068; F04D 25/0693

USPC ..... 417/423.5

See application file for complete search history.

(56) References Cited

U.S. PATENT DOCUMENTS

| | | | | |
|---|---|---|---|---|
| 2,373,497 | A * | 4/1945 | Paiste, Jr. | F24F 7/013 417/315 |
| 3,469,772 | A * | 9/1969 | McDonald | F04D 17/162 417/350 |
| 4,862,633 | A | 9/1989 | Adams, III | |
| 5,249,319 | A | 10/1993 | Higgs | |
| 6,237,653 | B1 | 5/2001 | Chaffee | |
| 6,287,095 | B1 | 9/2001 | Saputo et al. | |
| 6,887,173 | B2 | 5/2005 | Lacroix et al. | |
| 6,990,700 | B2 | 1/2006 | Chung | |
| 6,997,829 | B2 | 2/2006 | Kennedy, III et al. | |
| 8,157,535 | B2 * | 4/2012 | Wang | A47C 27/082 417/26 |
| 8,656,541 | B2 | 2/2014 | Muollo | |
| 8,863,771 | B2 | 10/2014 | Wang et al. | |

(Continued)

OTHER PUBLICATIONS

UK Search and Examination Report dated Dec. 20, 2019 for corresponding UK Application No. GB1911149.1.

*Primary Examiner* — Charles G Freay
(74) *Attorney, Agent, or Firm* — Raymond Sun

(57) ABSTRACT

A pump assembly is provided for use with an inflatable product. The inflatable product has a chamber having an air inlet and an air outlet. The pump assembly has a pump unit that is positioned inside the chamber for inflating and deflating the chamber, the pump unit having a motor that is operatively coupled to a first blower and a second blower, with the first blower is fluidly coupled to the air inlet and the second blower is fluidly coupled to the air outlet. The chamber is inflated by intake of air through the air inlet to the first blower and then into the chamber, and the chamber is deflated by drawing air from the chamber to the second blower and then out of the chamber through the air outlet.

18 Claims, 12 Drawing Sheets

(56) References Cited

U.S. PATENT DOCUMENTS

| | | | | |
|---|---|---|---|---|
| 9,211,018 | B2 | 12/2015 | Wang | |
| 10,443,602 | B2 * | 10/2019 | Liu | F04D 17/168 |
| 2003/0215340 | A1 * | 11/2003 | Chung | F04D 25/084<br>417/229 |
| 2006/0085918 | A1 * | 4/2006 | Metzger | A47C 27/082<br>5/713 |
| 2008/0232982 | A1 | 9/2008 | Boyd et al. | |
| 2010/0044468 | A1 * | 2/2010 | Granger | F04D 25/02<br>239/304 |

* cited by examiner

BUILT-IN AIR PUMP ASSEMBLY

BACKGROUND OF THE INVENTION

1. Field of the Invention

The present invention relates to air pumps, and more particularly to a built-in air pump that can be deployed for inflation and deflation of an inflatable product, such as an air mattress.

2. Description of the Prior Art

Inflatable products have become very popular. In particular, inflatable air mattresses have become a very useful item that has found use at homes, camping and other applications. These inflatable air mattresses are typically inflated and deflated by air pumps. Some of these mattresses have been provided with built-in air pumps that can be stored in a socket or space that is provided in the housing of the mattress, and then pulled out and deployed for use in inflating and deflating the mattress.

Many of the existing built-in air pumps suffer from a number of drawbacks. For example, the construction of these built-in air pumps can be complicated which leads to increased cost and reliability issues. In addition, many of the existing pump units have their vents exposed to the environment when the product is either inflated in use or deflated for storage (i.e., when the pump unit is not in use), so that the interior of the pump units can be contaminated by water or dirt.

In addition, many of the existing air pumps in the market have different functions due to the structural transformation of the air duct. These pumps have complicated air passages and many components that must be structurally matched, which often leads to large airflow loss and high air leakage during the inflation process. At the same time, the complicated structure also increases the difficulties and costs of production.

Therefore, there remains a need for more effective built-in air pumps that can be used with inflatable products, such as mattresses, and which avoids the drawbacks of the present pump units.

SUMMARY OF THE DISCLOSURE

In order to accomplish the objects of the present invention, there is provided a pump assembly for use with an inflatable product. The inflatable product has a chamber having an air inlet and an air outlet. The pump assembly has a pump unit that is positioned inside the chamber for inflating and deflating the chamber, the pump unit having a motor that is operatively coupled to a first blower and a second blower, with the first blower is fluidly coupled to the air inlet and the second blower is fluidly coupled to the air outlet. The chamber is inflated by intake of air through the air inlet to the first blower and then into the chamber, and the chamber is deflated by drawing air from the chamber to the second blower and then out of the chamber through the air outlet.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices and mechanisms are omitted so as to not obscure the description of the present invention with unnecessary detail.

Figure 1:
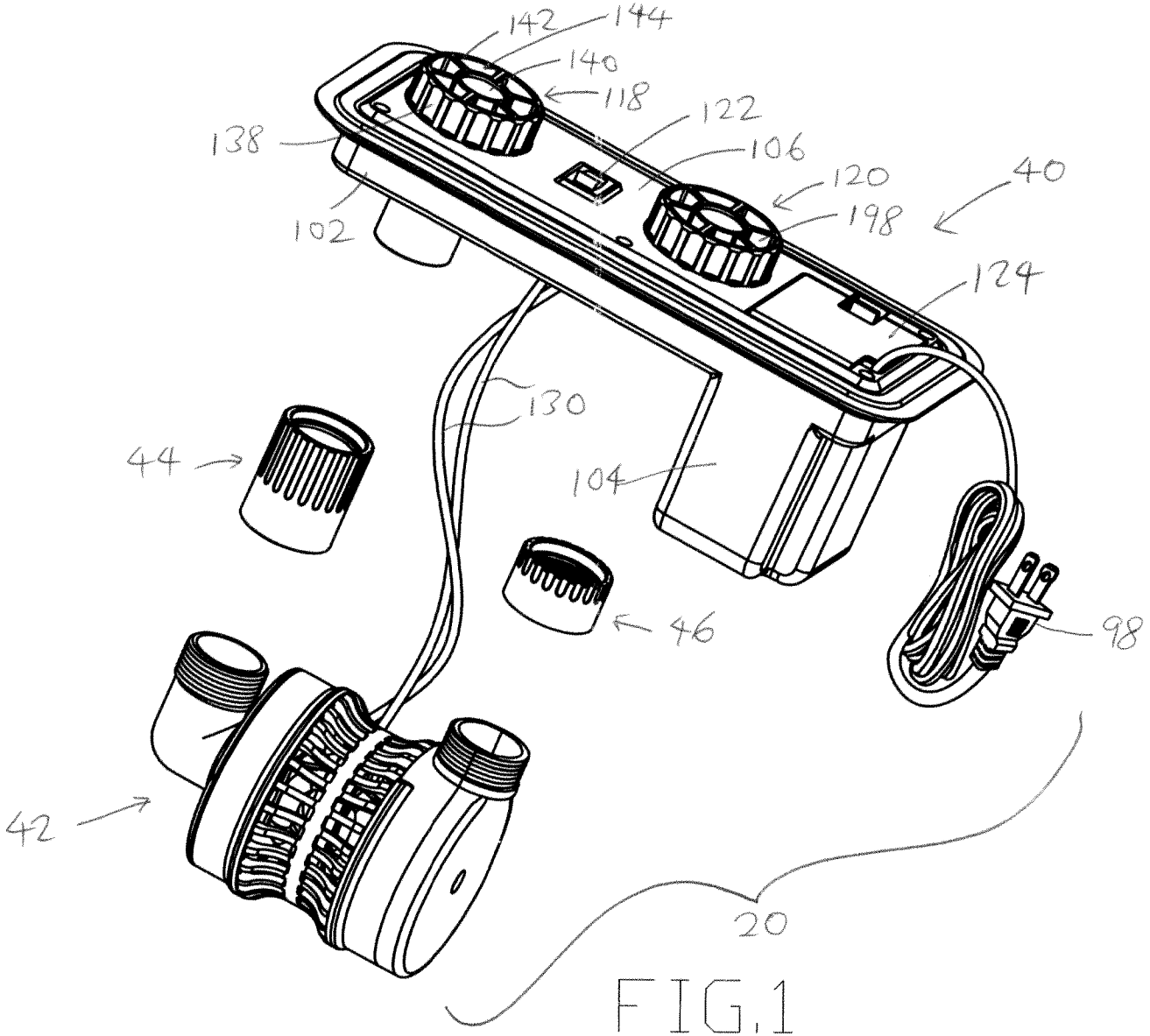
FIG. 1 is an exploded perspective view of the main components of a built-in pump assembly according to one embodiment of the present invention.
Figure 2:
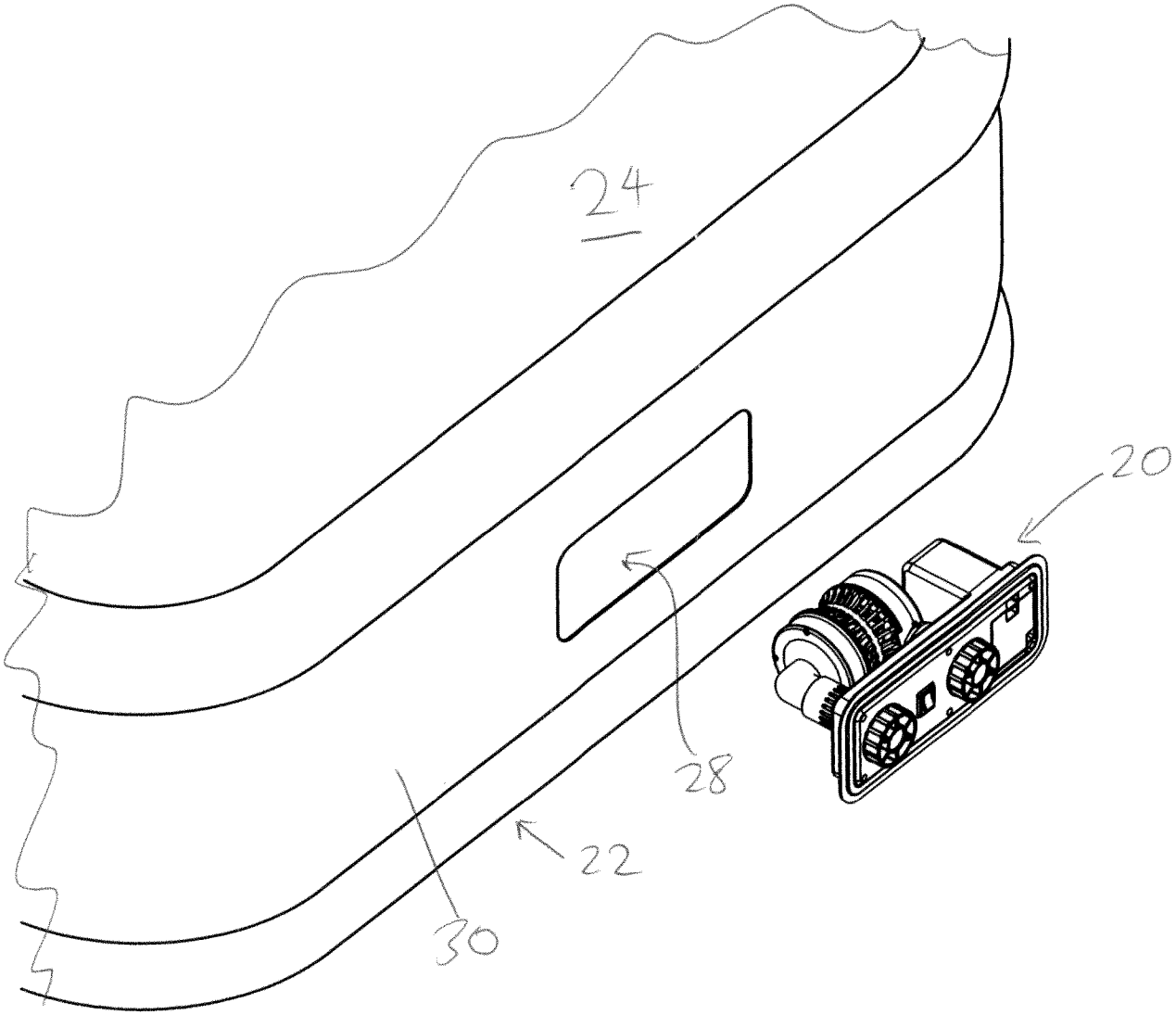
FIG. 2 is a perspective view of an inflatable mattress with the pump assembly of FIG. 1 incorporated therein.
Figure 3A:
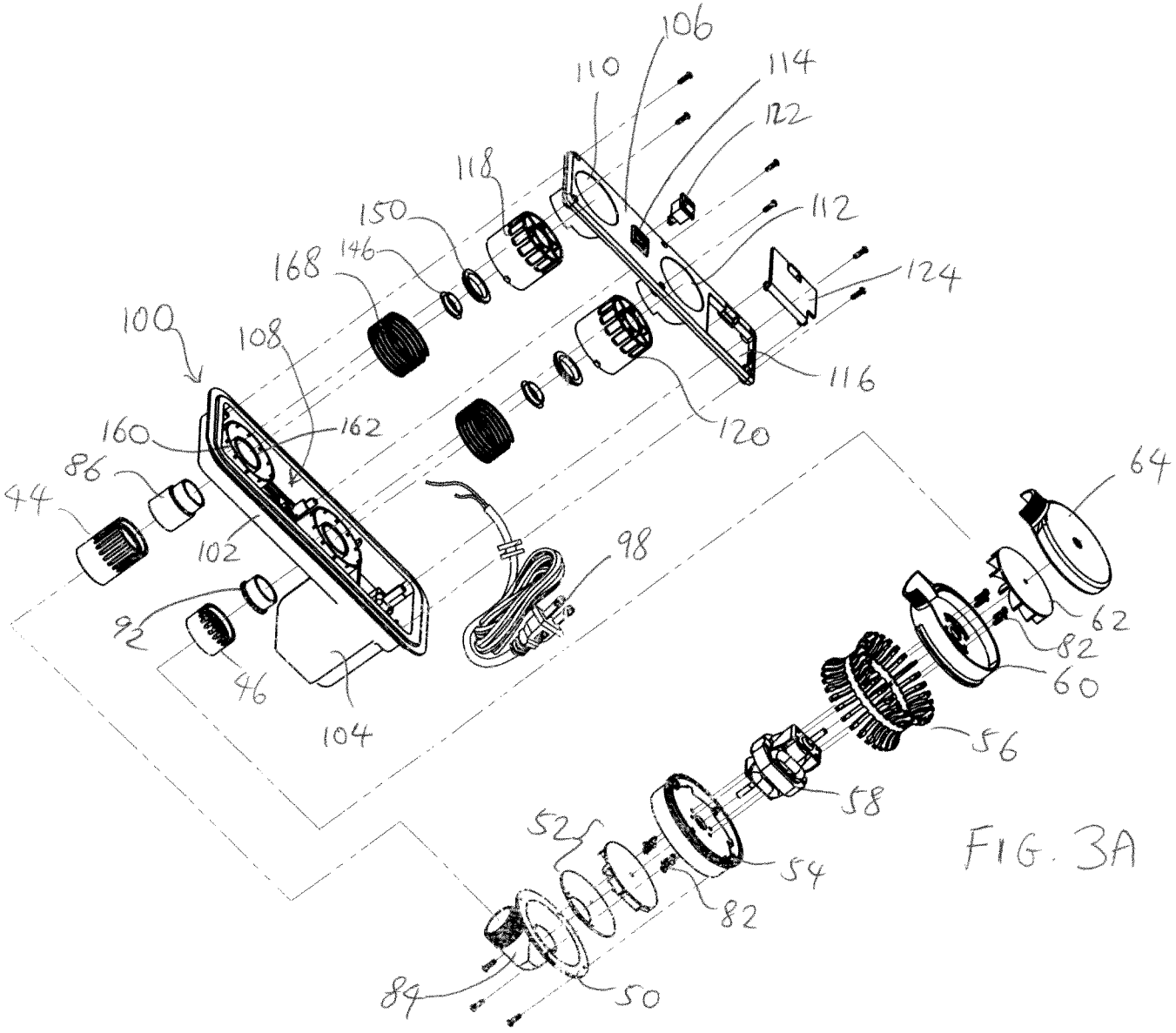
FIG. 3A is an exploded view of the main components of FIG. 1.
Figure 3B:
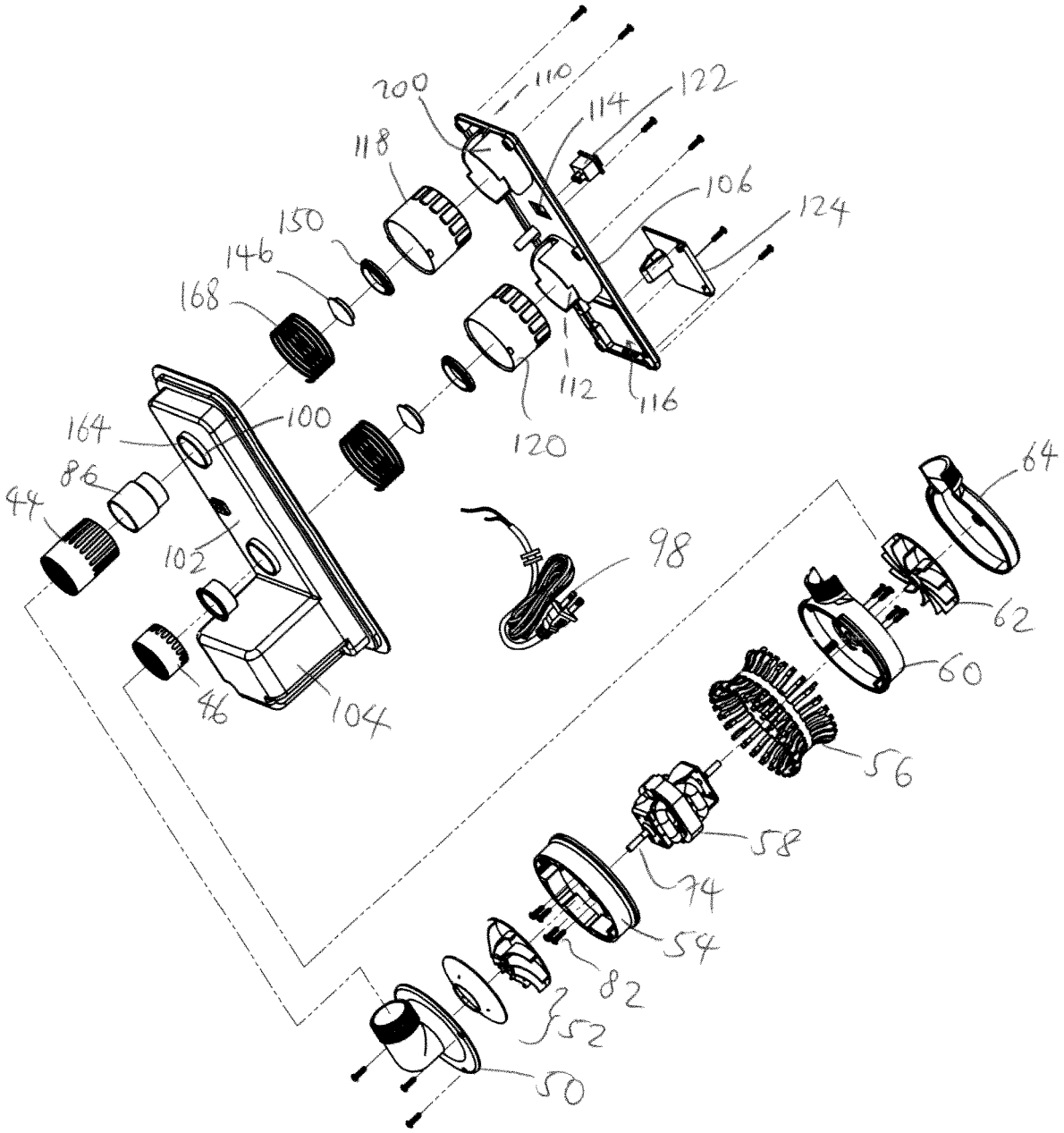
FIG. 3B is another exploded view of the main components of FIG. 1.

Referring to FIG. 2, the pump assembly 20 of the present invention can be built in to the body 24 of an inflatable mattress 22. Specifically, the inflatable mattress 22 can have an inflatable bladder or body 24, and a recessed region 28 provided in a side wall 30 of the body 24. The pump assembly 20 can be secured to the recessed region 28 by high frequency welding.

Referring now to FIGS. 1 and 3-6B, the pump assembly 20 has a control housing assembly 40, a pump unit that is a double-blower assembly 42, and two connection tubes 44 and 46 that function as air ducts. The control housing assembly 40 houses the electronics and switches, air inlets, and air outlets, as explained in greater detail below. The double-blower assembly 42 is provided below the control housing assembly 40 and is separate and spaced-apart from the control housing assembly 40. An intake connection tube 44 couples the air inlet of the control housing assembly 40 with one blower of the double-blower assembly 42, and an exhaust connection tube 46 couples the air outlet of the control housing assembly 40 with the other blower of the double-blower assembly 42.

Double Blower Assembly 42

Figure 6A:
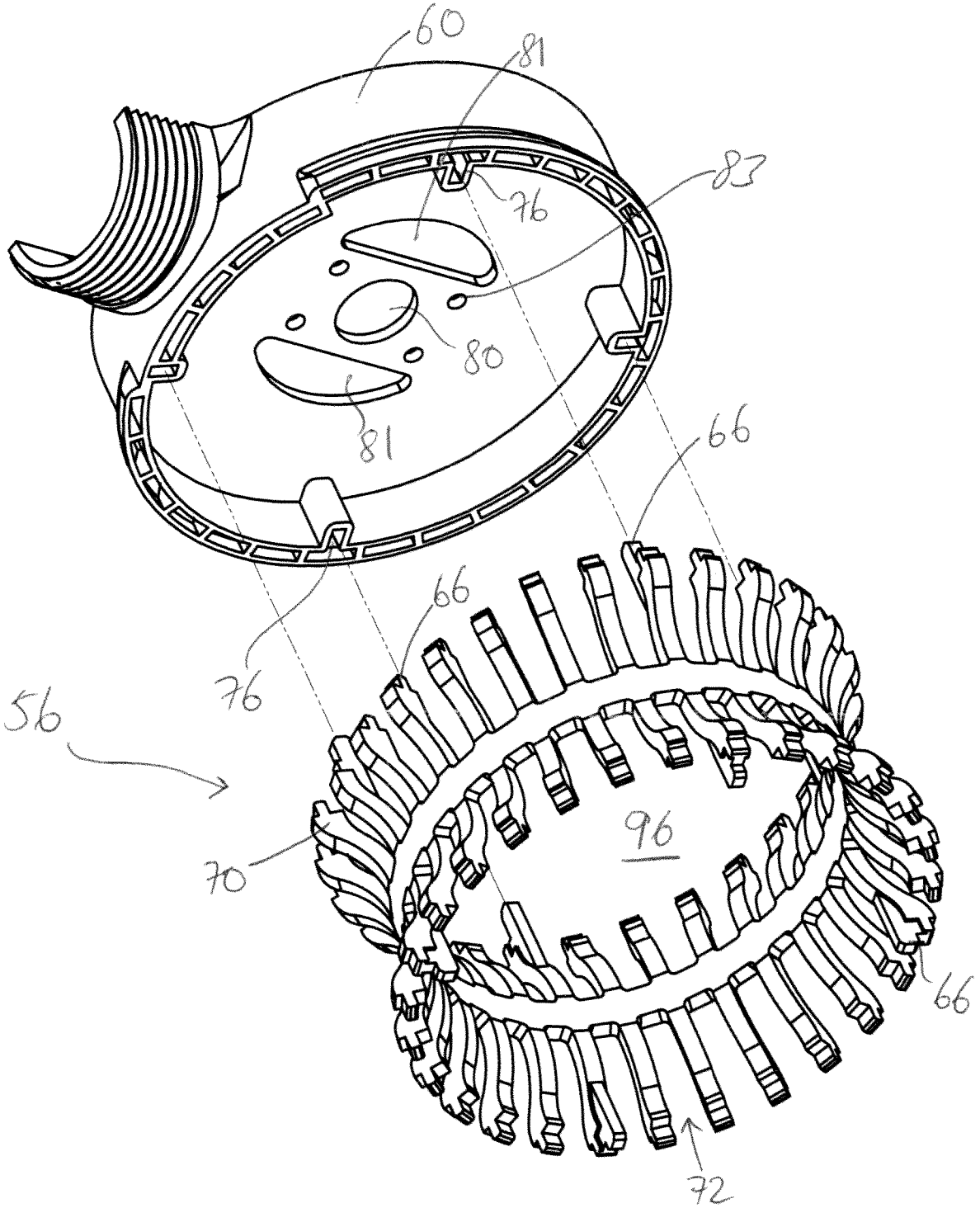
FIG. 6A is an exploded view illustrating the connection of the exhaust motor support and the protective net.
Figure 6B:
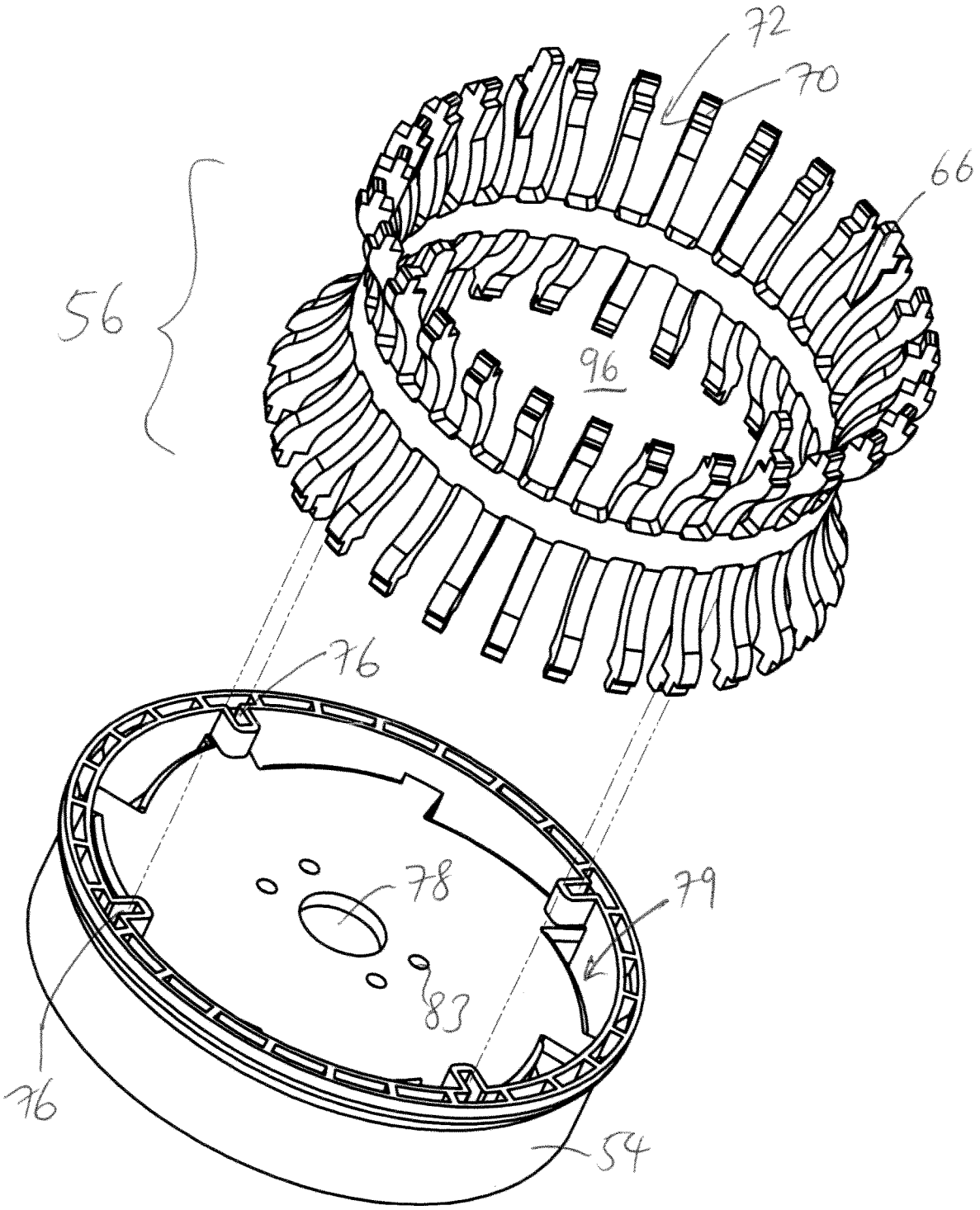
FIG. 6B is an exploded view illustrating the connection of the intake motor support and the protective net.
Figure 7:
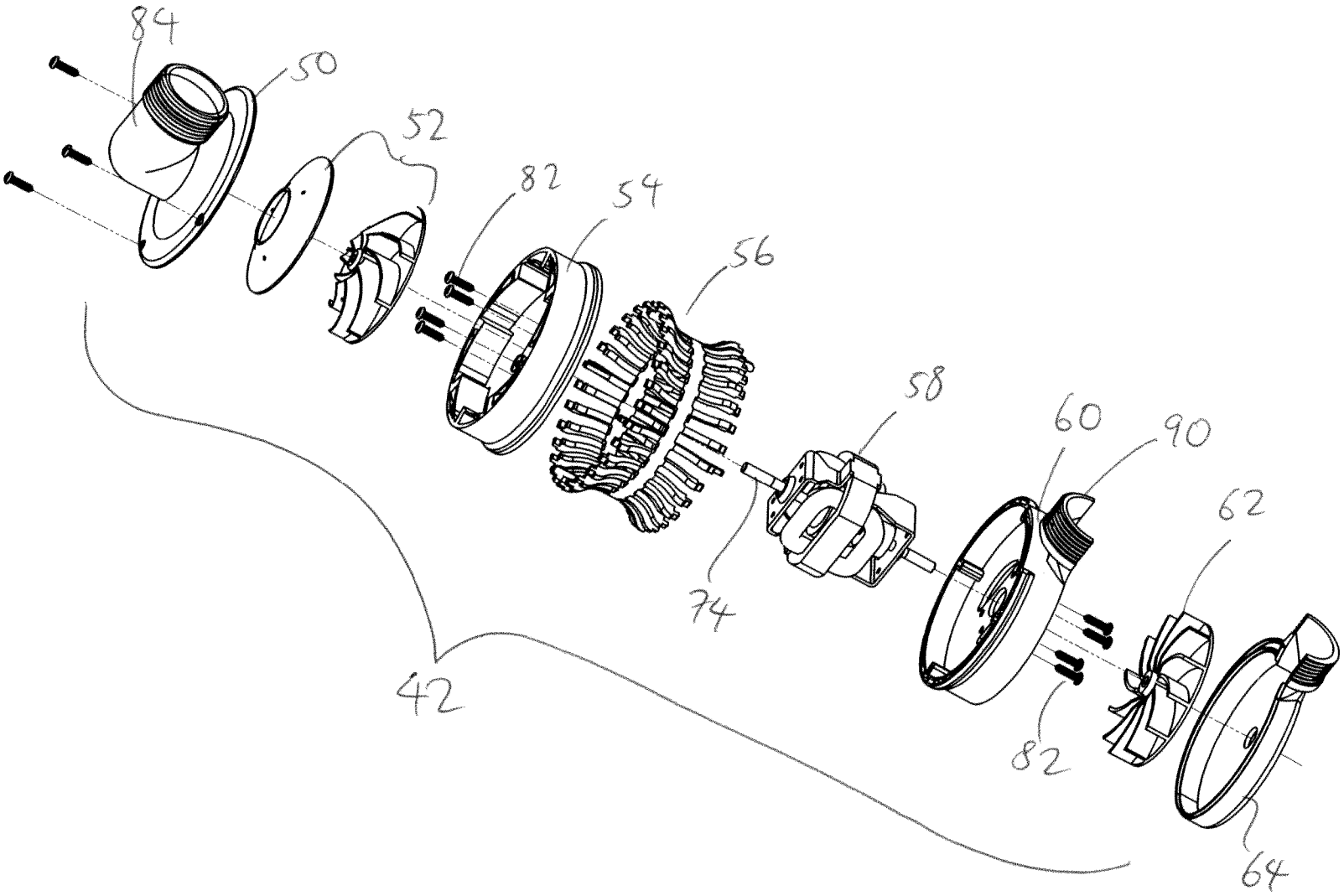
FIG. 7 is an exploded view of the double blower assembly of the pump assembly of FIGS. 1-5.

Referring to FIGS. 6A, 6B and 7, the double-blower assembly 42 has an intake cover 50, an intake blower 52, an intake motor support 54, a protective net 56, a motor 58, an exhaust motor support 60, an exhaust blower 62 and an exhaust cover 64. The intake cover 50 and the intake motor support 54 are secured together to define an intake housing having a chamber with the intake blower 52 housed therein, and the exhaust cover 64 and the exhaust motor support 60 are secured together to define an exhaust housing having a chamber with the exhaust blower 62 housed therein.

The protective net 56 is secured between the two motor supports 54 and 60. In particular, as best shown in FIGS. 6A, 6B and 7, the protective net 56 is made of a plurality of net strands 70, with four net strands having notches 66 at their ends that are adapted to be fitted into aligned holes 76 that are provided in spaced-apart manner along the periphery of the motor supports 54 and 60. The motor 58 is housed inside the protective net 56, and screws 82 can be used to secure the motor 58 to the two motor supports 54 and 60 via openings 83, thereby causing the protective net 56 to be retained in place between the two motor supports 54 and 60. The strands 70 of the protective net 56 can be made from a polymer material, such as Acrylonitrile Butadiene Styrene (ABS), and spaces 72 are defined between adjacent strands 70. These spaces 72 extend circumferentially around the protective net 56. The net 56 can have a concave or V-shape.

The motor 58 has a single shaft 74 having a first end that extends through an opening 78 in the intake motor support 54 to be connected to the intake blower 52, and a second end that extends through an opening 80 in the exhaust motor support 60 to be connected to the exhaust blower 62.

The intake cover 50 has a hollow L-shaped arm or elbow 84 extending therefrom and is threadably coupled to the intake connection tube 44. Similarly, the exhaust cover 64 has an outlet port 90 (see FIG. 7) extending upwardly therefrom and is coupled to the exhaust connection tube 46.

Openings 79 and 81 are provided in the inner walls of the motor supports 54 and 60, respectively, (see FIGS. 6A and 6B) allow air to be transferred to and from the chambers of the intake housing and exhaust housing, respectively, to the region 96 surrounded by the protective net 56. The openings 79 can be angular slits provided along the edge of the wall of the motor support 54 that also carries the opening 78, while the openings 81 can be two semi-circular openings provided on the same wall of the motor support 60 as the other opening 80. The motor 58 is retained or housed in this region 96. Thus, when air is being pumped from the external environment into the interior of the mattress body 24, the air passes through the tube 86 into the intake housing where the intake blower 52 directs the air out through the openings 79 to the region 96 surrounded by the net 56, and then the air escapes into the interior of the mattress body 24 via the spaces 72 between the strands 70. See FIG. 4 and the arrows that show the air flow. Conversely, when air is being pumped from the interior of the mattress body 24 to the external environment, the air is drawn in to the region 96 surrounded by the net 56 by the exhaust blower 62, and from the region 96 surrounded by the net 56, the air is drawn into the chamber of the exhaust housing via the openings 81, and then exits through the outlet port 90 through the tube 92 into the external environment. See FIG. 5 and the arrows that show the air flow. In this regard, it can be seen that positioning the motor 58 inside the region 96 surrounded by the net 56 allows the motor 58 to be cooled when air is either drawn in to, or drawn out from, the interior of the mattress body 24.

Control Housing Assembly 40

Referring to FIGS. 1, 3A, 3B, 4 and 5, the control housing assembly 40 has a housing that has an elongated generally rectangular section 102, and a storage section 104 that extends downwardly from one end of the rectangular section 102. A cover 106 covers the opened upper end of the rectangular section 102, and together with the rectangular section 102, defines an interior compartment 108. Four openings are provided in the cover 106, an intake opening 110, an exhaust opening 112, a control button opening 114, and a storage opening 116.

An intake knob 118 extends through the intake opening 110. An exhaust knob 120 extends through the exhaust opening 112. A control button 122 extends through the control button opening 114. A storage lid 124 is pivotably coupled to the storage opening 116. The storage section 104 can be used to house the electrical wiring and power plug 98, with access to the internal storage space 126 of the storage section 104 provided by lifting or closing the storage lid 124. The storage section 104 can also be a battery compartment (not shown) if the pump assembly 20 is used with a DC motor. The control button 122 is used to turn the motor 58 on or off. In this regard, the control button 122 is coupled to wires 130 that electrically connect the control button 122 to the motor 58.

Figure 8A:
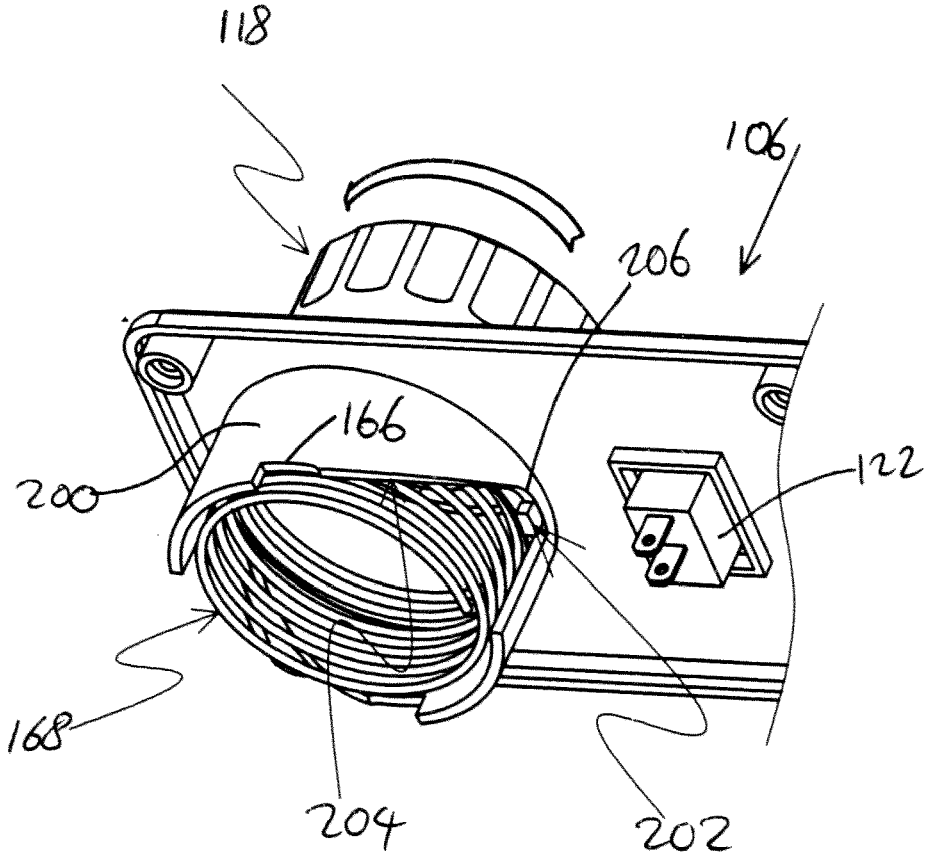
FIG. 8A and FIG. 8B illustrate how the knob is opened and closed.
Figure 8B:
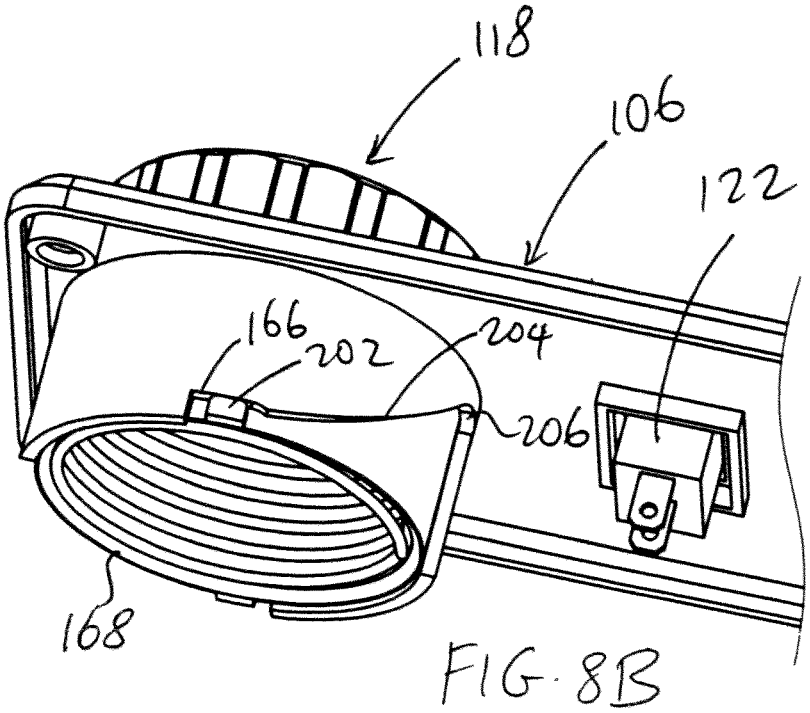

The intake knob 118 has a hollow cylindrical body 136 that can have ribbed outer surfaces 138 to allow the user to grip and turn the knob 118. A generally circular central hub 140 is provided at the upper end of the knob 118, with the hub 140 connected to the body 136 by spokes 142. Air passages 144 are defined between the spokes 142. The central hub 140 extends into the hollow interior of the body 136 and terminates at a holder 146. A flange 148 extends around the external wall of the hub 140, and a silicone seal 150 is positioned under the flange 148 and secured by the holder 146. The holder 146 has a conical shape so that it can more efficiently direct airflow. In addition, the thickness of the body 136 adjacent its upper end is slightly greater than the thickness elsewhere, so as to define an annular ridge 152. A latch button 202 is provided on the outer surface of the cylindrical body 136 adjacent the lower end thereof. See also FIGS. 8A and 8B.

A cylindrical guide wall 200 extends downwardly from the opening 110 in the cover 106. A portion of the cylindrical wall of the guide wall 200 is cut out to define a rest shoulder 206, a guide rail surface 204, and a slot 166. The latch button 202 is adapted to be seated in the rest shoulder 206 when the knob 118 is opened (see FIG. 8A), is adapted to slide downwardly along the guide rail surface 204, and to be secured at the slot 166 when the knob 118 is closed (see FIG. 8B).

A first cylindrical wall 160 is defined inside the rectangular section 102 under the intake opening 110. A second cylindrical wall 162 is defined inside the first cylindrical wall 160, and extends through an opening 164 in the bottom wall of the rectangular section 102 to an annular flange 100. See FIG. 5. The annular flange 100 is adapted to communicate with the open upper end of an inner tube 86; in particular, the open upper end of the inner tube 86 extends into and through the opening 164 surrounded by the flange 100. The interior of the second cylindrical wall 162 defines an air channel 180 that communicates with the tubes 86 and 44 via the opening 164. A spring 168 is adapted to be seated in the space 170 between the two cylindrical walls 160 and 162, surrounding the second cylindrical wall 162.

The intake knob 118 is adapted to extend through the intake opening 110 and has an annular lower lip 172 that functions to retain the knob 118 inside the space 170 by engaging an annular ledge 174 defined at the intake opening 110 at the cover 106. The spring 168 is seated in the space 170 and extends upwardly to surround the central hub 140, with the upper end of the spring 168 abutting the annular ridge 152 to retain the upper end of the spring 168 inside the knob 118.

In use, the knob 118 can be turned clockwise to seal the air channel 180 by turning and pressing the knob 118 down, and which causes the latch button 202 to travel from the rest shoulder 206 to the slot 166. In this position, the holder 146 extends into the interior of the second cylindrical wall 162 and the silicone seal 150 and the flange 148 sit on the annular upper edge of the second cylindrical wall 162 to seal the air channel 180 shut. In addition, in this position, the bottom edge of the body 136 sits adjacent the bottom of the cylindrical walls 160 and 162. See FIG. 5.

Figure 4:
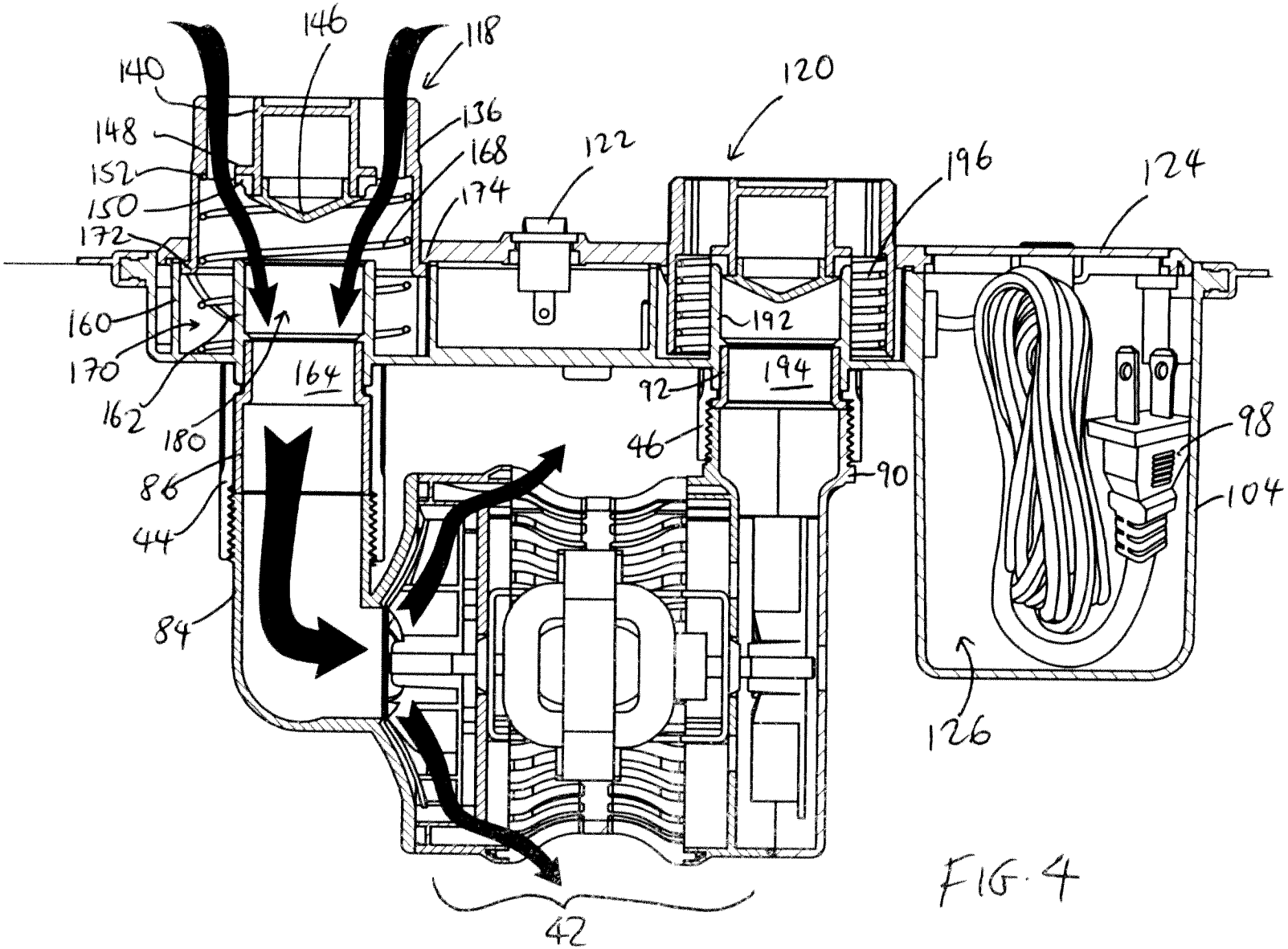
FIG. 4 is a cross-sectional view of the pump assembly of FIGS. 1-3 showing the intake of air into the mattress.
Figure 5:
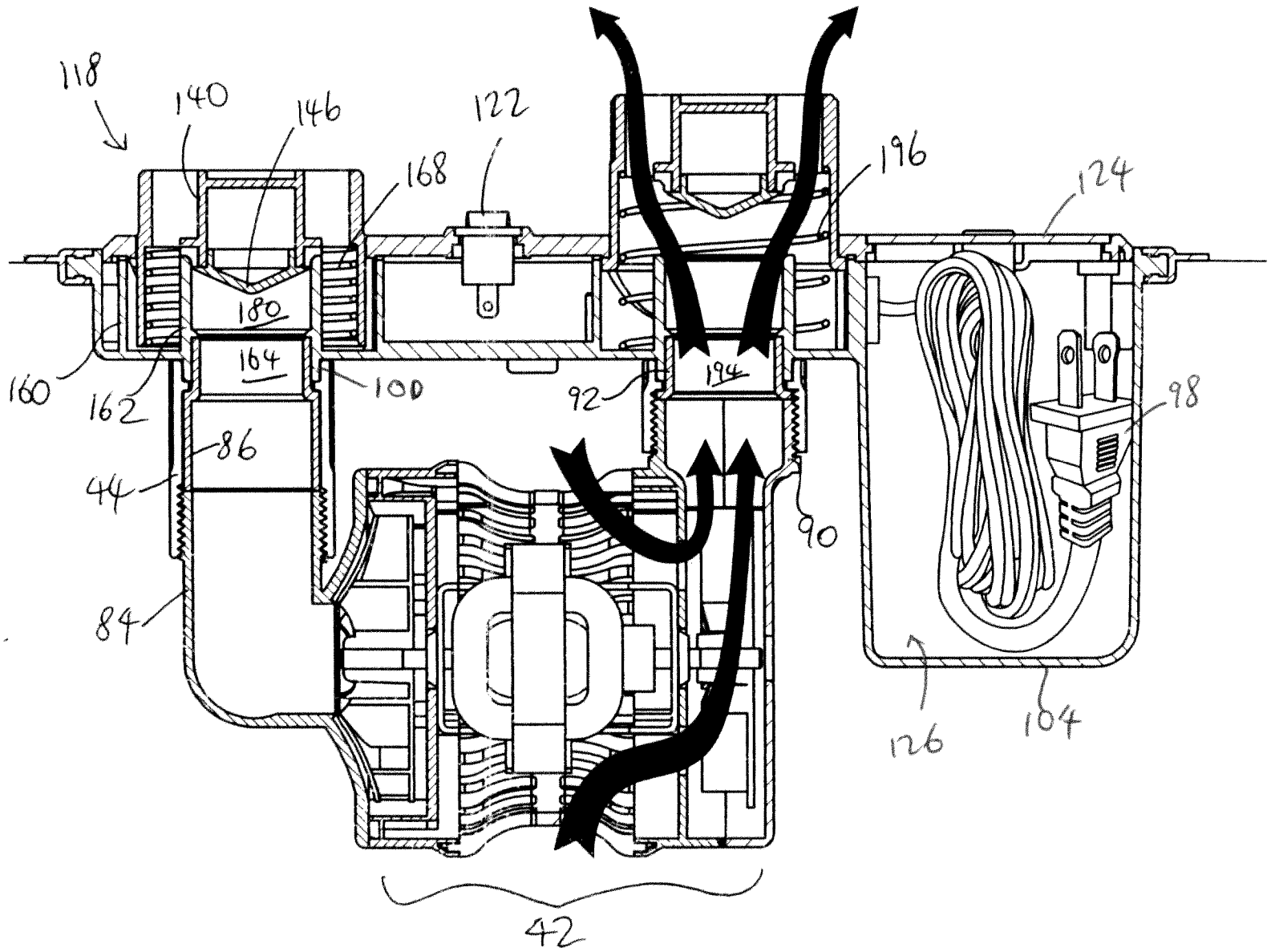
FIG. 5 is a cross-sectional view of the pump assembly of FIGS. 1-3 showing air being pumped out of the mattress.

The knob 118 can also be turned counter-clockwise to open the intake opening 110. Turning the knob 118 counter-clockwise will allow the bias of the spring 168 to automatically cause the knob 118 to be pushed up, causing the latch button 202 to move from the slot 166 to the rest shoulder 206. The annular lower lip 172 retains the knob 118 inside the space 170 by engaging the annular ledge 174 defined at the intake opening 110 at the cover 106 to prevent the knob 118 from being disengaged from the cover 106. Ambient air can now pass through the air passages 144 into the interior of the body 136, and then travel into the air channel 180, through the opening 164, and into the tube 86 and then the arm 84. As best shown in FIG. 4, the bottom of the tube 86 communicates with the opened top end of the arm 84, with the connection tube 44 acting as a sleeve to encircle the lower end of the tube 86 and the upper end of the arm 84 by a threadable engagement.

The construction and operation of the exhaust knob 120 can be identical to that of the intake knob 118. Similarly, two cylindrical walls 190 and 192 can also be provided under the exhaust opening 112, and have the same construction, and operate in the same manner, as the cylindrical walls 160 and 162 under the intake opening 110.

In use, the knob 120 can be turned clockwise to seal the air channel 194 by turning and pressing the knob 120 down, and then engaging a latch button (not shown, but the same as 202) with a slot (not shown, but the same as 166). In this position, the central hub of the knob 120 extends into the interior of the second cylindrical wall 192 and a silicone seal (similar to 150) and a flange (similar to 148) sit on the annular upper edge of the second cylindrical wall 192 to seal the air channel 194 shut. In addition, in this position, the bottom edge of the body of the knob 120 sits adjacent the bottom of the cylindrical walls 190 and 192. See FIG. 4.

The knob 120 can also be turned counter-clockwise to open the exhaust opening 112. Turning the knob 120 counter-clockwise will cause the latch button to move from the slot to a rest shoulder, and the bias of the spring 196 will automatically cause the knob 120 to be pushed up. Air from inside the inflatable mattress 24 can now pass through the outlet port 90, and the inner tube 92 into the air channel 194, and then exit through the air passages 198 in the knob 120. See FIG. 5. The connection tube 46 acts as a sleeve to encircle the lower end of the tube 92 and the upper end of the outlet port 90 by a threadable engagement Operation When the inflatable mattress 24 is to be inflated, the user opens the intake knob 118 in the manner described above, and then presses the control button 122 to turn on the motor 58. As explained above, air is then delivered from the external environment through the air passages 144 into the air channel 180 and then into the tube 86, and then through the arm or elbow 84 into the intake housing where the intake blower 52 directs the air out through the openings 79 to the region 96 surrounded by the net 56, and then the air escapes into the interior of the mattress body 24 via the spaces 72 in the net 56. When the mattress 24 has been inflated, the user turns off the motor 58 but pressing the control button 122 again, and then pushes the intake knob 118 down to seal the air channel 180.

When the inflatable mattress 24 is to be deflated, the user opens the exhaust knob 120 in the manner described above, and then presses the control button 122 to turn on the motor 58. As explained above, the exhaust blower 62 draws air drawn into the region 96 surrounded by the net 56 via the spaces 72, and from the region 96 surrounded by the net 56, the air is drawn into the chamber of the exhaust housing via the openings 81, and then exits through the outlet port 90 through the tube 92, the air channel 194 and the air passages 198 into the external environment.

Figure 9:
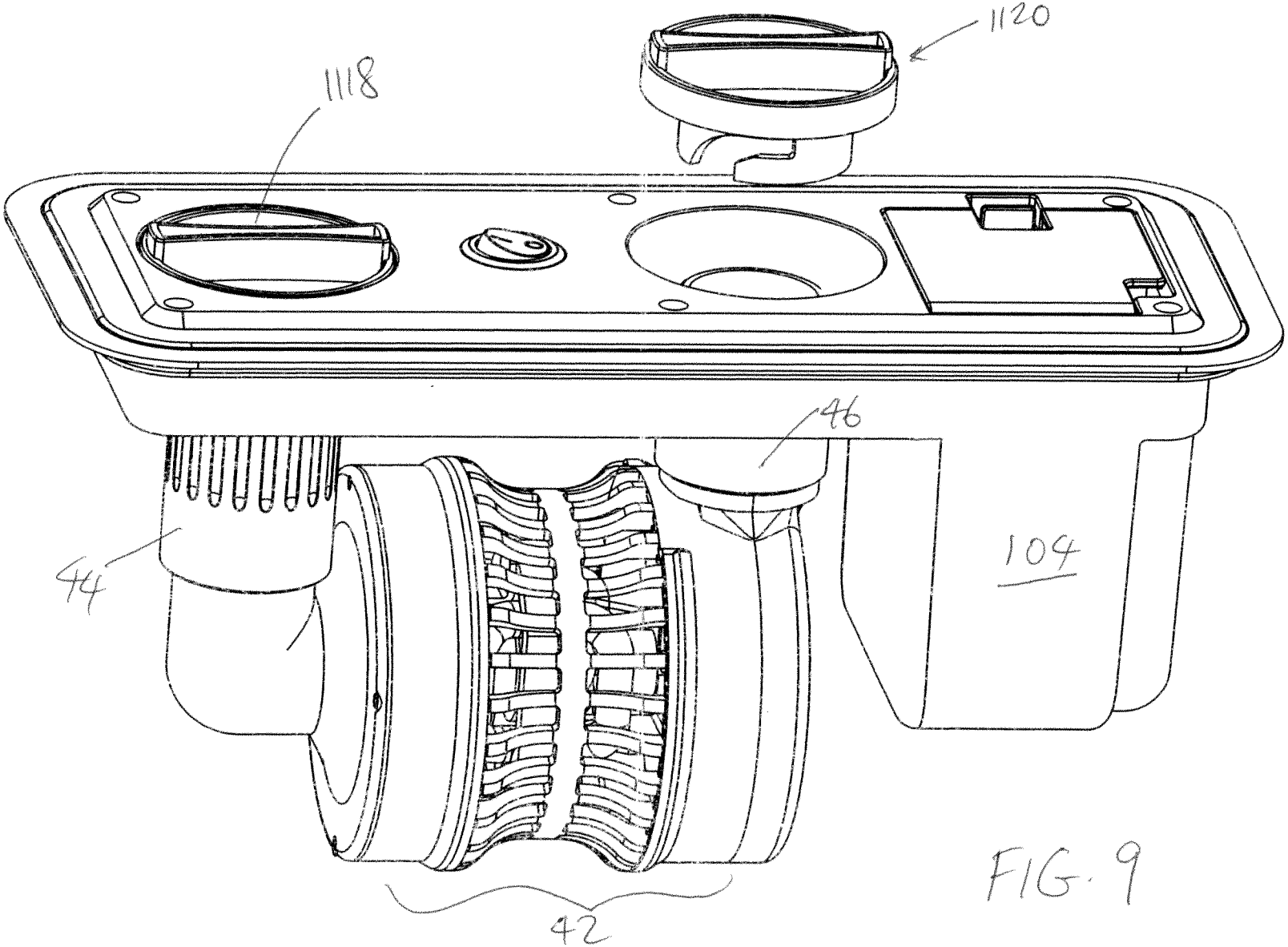
FIG. 9 is a perspective assembled view of the pump assembly according to yet another embodiment of the present invention.
Figure 10:
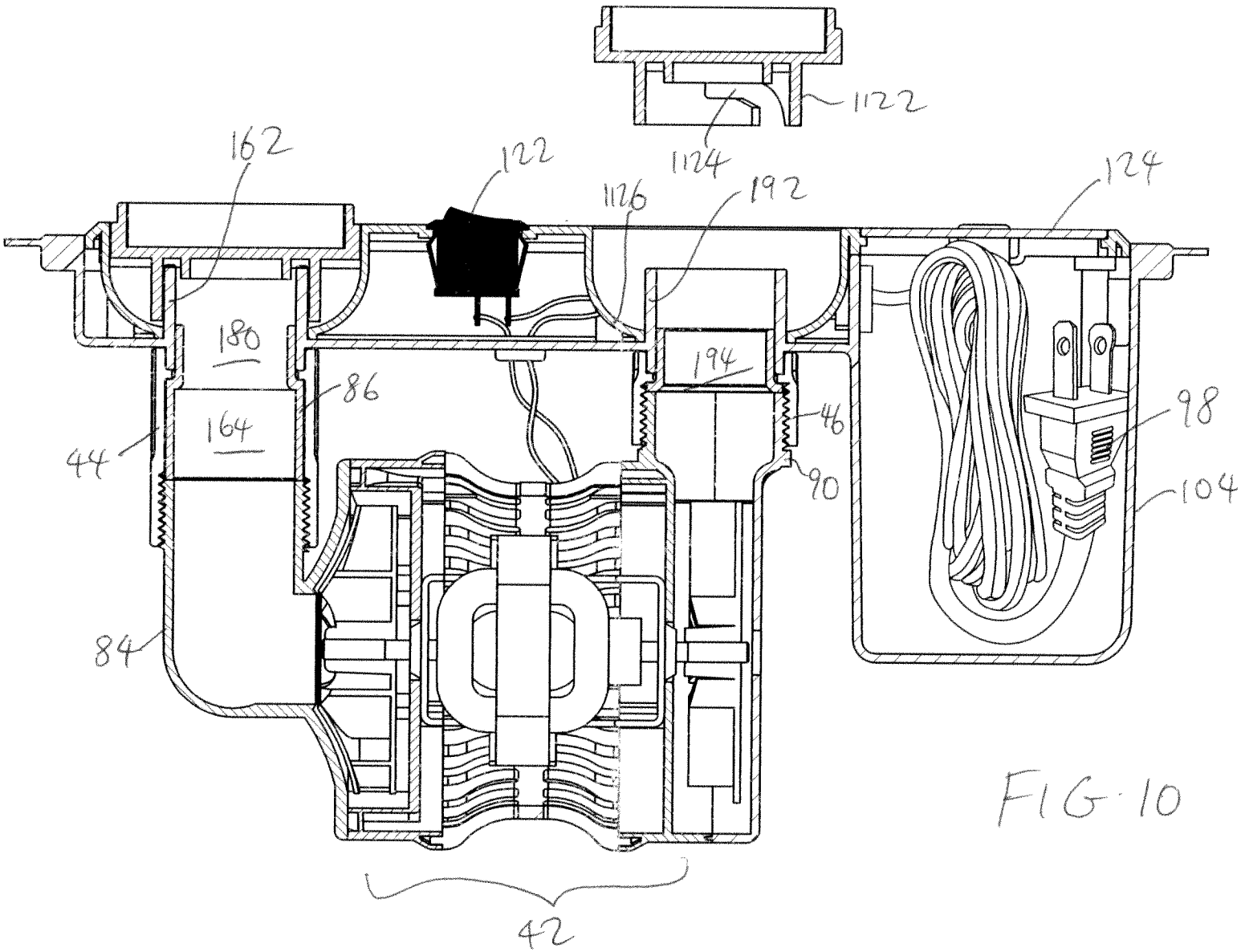
FIG. 10 is a cross-sectional view of the pump assembly of FIG. 9.

It should be noted that both blowers 52 and 62 are turned on during inflation and deflation. However, inflation and deflation performance is not negatively impacted because one of the knobs 118 or 120 seals either the inlet or the outlet shut, thereby creating a vacuum state for the inlet or outlet that is sealed Alternative Embodiment FIGS. 9-10 illustrate another embodiment of the present invention. The embodiment in FIGS. 9-10 is the same as the embodiment in FIGS. 1-7, except that the knobs 118 and 120 are now replaced by screw caps 1118 and 1120. Otherwise, all the other elements that are the same as those in the embodiment of FIGS. 1-7 have the same numeral designations.

In the embodiment of FIGS. 9-10, the springs 168 are now omitted as they are unnecessary. Each screw cap 1118 and 1120 has a generally cylindrical ledge 1122 with a curved slot 1124 cut out of a portion of the ledge 1122. The curved slot 1124 is adapted to receive a curved ridge (not shown) extending from the base 1126 of the rectangular section 102. The ledge 1122 surrounds the cylindrical wall 162 or 192 when the screw cap 1118 or 1120 is screwed tight to shut the air channels 180 and 194. The inflate/deflate operations of this embodiment are identical to the inflate/deflate operations of the embodiment in FIGS. 1-7.

Benefits

The pump assembly 20 of the present invention provides a number of important benefits. First, the construction of the double-blower assembly 42 with the motor 58 supported between the two blowers 52 and 62 allows air to be delivered into and out of the body 24 very quickly. In particular, the air that is drawn in by the intake blower 52 exits the intake motor support 54 and spreads out very quickly around the motor 58, through the net 56 and into the body 24. Conversely, air that is drawn from the body 24 by the exhaust blower 62 can enter the exhaust motor support 60 from all over the net 56 and the motor 58, thereby speeding up the exhaust of air from the body 24. In fact, the net 56 can even be omitted to provide less obstruction to the air flow.

Second, the double-blower assembly 42 of the present invention improves efficiency. For example, by increasing power by only 8%, the double blower assembly 42 can achieve an increase in pressure by 60%.

Third, unlike many conventional pump units which utilize the same channels and tubes to draw in air and to exhaust air, the double blower assembly 42 of the present invention provides separate and independent inlets and outlets, which greatly reduces the loss caused by the flow resistance of the compressed air. This provides for rapid inflation and maximized air compression, with compression flow increased by more than 150% compared with the traditional pumps in the market Fourth, the construction of the double blower assembly 42 is simple, thereby making it easier and cheaper for mass production and after-sale service.

The above detailed description is for the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices, components, mechanisms and methods are omitted so as to not obscure the description of the present invention with unnecessary detail.

What is claimed is:

1. An inflatable product, comprising:

a chamber having an air inlet and an air outlet;

a pump assembly having a pump unit positioned inside the chamber for inflating and deflating the chamber, the pump unit having a motor that is operatively coupled to a first blower and a second blower, wherein the first blower is fluidly coupled to the air inlet and the second blower is fluidly coupled to the air outlet;

wherein the chamber is inflated by intake of air through the air inlet to the first blower and then into the chamber, and the chamber is deflated by drawing air from the chamber to the second blower and then out of the chamber through the air outlet.

2. The product of claim 1, wherein the motor has a shaft with opposite first and second ends, with the first blower connected to the first end and the second blower connected to the second end.

3. The product of claim 1, wherein the air outlet is sealed when the chamber is inflated.

4. The product of claim 1, wherein the air inlet is sealed when the chamber is deflated.

5. The product of claim 1, wherein the pump unit includes a net that surrounds the motor.

6. The product of claim 5, wherein the net is concave.

7. The product of claim 5, wherein the net has a plurality of spaces through which air can flow.

8. The product of claim 1, wherein both the first and second blowers are actuated by turning on the motor when the chamber is inflated.

9. The product of claim 1, wherein both the first and second blowers are actuated by turning on the motor when the chamber is deflated.

10. The product of claim 1, further including an intake cover, a first motor support, a net, a second motor support, and an exhaust cover, wherein the intake cover and the first motor support are secured together to define an intake housing that houses the first blower therein, and the exhaust cover and the second motor support are secured together to define an exhaust housing that houses the second blower therein, and wherein the net surrounds the motor and has a first end and a second end, with the first end of the net coupled to the first motor support and the second end of the net coupled to the second motor support.

11. The product of claim 1, further including a tube which connects the air inlet with the first blower.

12. The product of claim 1, further including a tube which connects the air outlet with the second blower.

13. A method of inflating an inflatable product that has a chamber having an air inlet and an air outlet, comprising:

providing a pump assembly having a pump unit positioned inside the chamber for inflating and deflating the chamber, the pump unit having a motor that is operatively coupled to a first blower and a second blower, wherein the first blower is fluidly coupled to the air inlet and the second blower is fluidly coupled to the air outlet;

opening the air inlet while maintaining the air outlet sealed; and turning on the motor to draw ambient air through the air inlet to the first blower and then into the chamber.

14. The method of claim 13, wherein both the first and second blowers are actuated by turning on the motor when air is drawn into the chamber.

15. The method of claim 14, wherein the motor has a shaft with opposite first and second ends, with the first blower connected to the first end and the second blower connected to the second end.

16. A method of deflating an inflatable product that has a chamber having an air inlet and an air outlet, comprising:

providing a pump assembly having a pump unit positioned inside the chamber for inflating and deflating the chamber, the pump unit having a motor that is operatively coupled to a first blower and a second blower, wherein the first blower is fluidly coupled to the air inlet and the second blower is fluidly coupled to the air outlet;

opening the air outlet while maintaining the air inlet sealed; and turning on the motor to draw air from the chamber through the second blower and then out of the chamber through the air outlet.

17. The method of claim 16, wherein both the first and second blowers are actuated by turning on the motor when air is removed from the chamber.

18. The method of claim 17, wherein the motor has a shaft with opposite first and second ends, with the first blower connected to the first end and the second blower connected to the second end.

* * * * *